US005980919A

United States Patent [19]

Greenfield et al.

[11] Patent Number: 5,980,919

[45] Date of Patent: Nov. 9, 1999

[54] EMOLLIENT COMPOSITIONS AND METHODS OF APPLICATION TO A SUBSTRATE BY ELECTROSTATIC SPRAYING

[75] Inventors: Steven H. Greenfield, Duluth, Minn.; Edwin D. Culligan, Clarkston, Wash.

[73] Assignee: Potlatch Corporation, Spokane, Wash.

[21] Appl. No.: 08/966,892

[22] Filed: Nov. 10, 1997

[51] Int. Cl.[6] ..... A61K 7/00; B05D 1/04

[52] U.S. Cl. ..... 424/401; 239/3; 427/475; 427/458; 524/901

[58] Field of Search ..... 424/401; 427/475, 427/458; 239/3; 524/901

[56] References Cited

U.S. PATENT DOCUMENTS

| | | |
|---|---|---|
| 3,484,275 | 12/1969 | Lewicki . |
| 3,656,455 | 4/1972 | Watanabe . |
| 3,843,585 | 10/1974 | Kangas et al. . |
| 3,896,807 | 7/1975 | Buchalter . |
| 3,947,396 | 3/1976 | Kangas et al. . |
| 4,112,167 | 9/1978 | Dake et al. . |
| 4,155,770 | 5/1979 | Doumani . |
| 4,191,609 | 3/1980 | Trokhan . |
| 4,318,900 | 3/1982 | Rowsell et al. . |
| 4,481,243 | 11/1984 | Allen . |
| 4,513,051 | 4/1985 | Lavash . |
| 4,673,380 | 6/1987 | Wagner . |
| 4,749,125 | 6/1988 | Escallon et al. . |
| 4,766,030 | 8/1988 | Hervey . |
| 4,780,746 | 10/1988 | Noramore et al. . |
| 4,844,902 | 7/1989 | Grohe . |

(List continued on next page.)

OTHER PUBLICATIONS

*The American Heritage Dictionary*, New College Edition, 3 pages (1982).

TOTALSTAT, United Air Specialists, Inc. (Cincinnati, Ohio, USA), "Electrostatic Fluid Spray Systems", Internet site address http://www.uasinc.com/total.html, pp. 1–6, (May 16, 1998).

Totalstat, United Air Specialists, Inc., "Electrostatic Fluid Spray Systems", pp. 1–8 (May 1997).

Thesis by Reid Alyn Brennen, "Large Displacement Electrostatic Microactuators with Polysilicon Flexure Suspensions", Internet site address http://mems.isi.edu/archives/dissertation–abstracts/ucb/phd93_1.html, p. 1, (May 15, 1997).

"The E & C Model", Internet site address http://inorganic1.chem.ufl.edu/ecm.htm, p. 1, (May 15, 1997).

Spectrum, The Electrostatic Sprayer, "Electrostatic Forces", Internet site address http://www.wantabe.com/spectrum/electro.html, pp. 1–2 (May 15, 1997).

ITW Ransburg, "Electrostatic Systems", Internet site address http://www.itwransburg.com/, p. 1, (May 16, 1997).

United Air Specialists, Internet site address http://www.uasinc.com/, pp. 1–2, (May 16, 1997).

United Air Specialists, Internet site address http://www.uasinc.com/history.html, pp. 1–3, (May 16, 1997).

Tri–Services' Pollution Prevention Technical Library, "Electrostatic Paint Spray System", Internet site address http://enviro.nfesc.navy.mil/p2library/paint2.htm, pp. 1–4, (May 21, 1997).

(List continued on next page.)

*Primary Examiner*—Thurman K. Page
*Assistant Examiner*—Brian K. Seidleck
*Attorney, Agent, or Firm*—Wells, St. John, Roberts, Gregory & Matkin, P.S.

[57] ABSTRACT

Conductive, flowable, emollient compositions and electrostatic methods for their application e.g., to tissue, are disclosed. Compositions of the invention include emollient(s) and conductivity modifiers. Emollient-compatible phosphates and succinates are particularly preferred families of conductivity modifiers. In methods of the invention conductive emollient composition of the invention are preferably applied to tissue substrates, particularly facial tissue substrates, and particularly in a commercial tissue-making process. Electrostatic spray processes are utilized to obtain surprisingly uniform application of conductive emollient to tissue with minimal overspray or spray path overlap.

6 Claims, 5 Drawing Sheets

U.S. PATENT DOCUMENTS

| | | |
|---|---|---|
| 4,894,118 | 1/1990 | Edwards et al. . |
| 4,943,389 | 7/1990 | Weete et al. . |
| 4,943,390 | 7/1990 | Hayes et al. . |
| 4,950,545 | 8/1990 | Walter et al. . |
| 4,960,592 | 10/1990 | Hagen et al. . |
| 4,981,729 | 1/1991 | Zaleski . |
| 5,075,113 | 12/1991 | DuBois . |
| 5,209,410 | 5/1993 | Wichmann et al. . |
| 5,227,242 | 7/1993 | Walter et al. . |
| 5,234,720 | 8/1993 | Neal et al. . |
| 5,246,546 | 9/1993 | Ampulski . |
| 5,252,246 | 10/1993 | Ding et al. . |
| 5,341,993 | 8/1994 | Haber et al. . |
| 5,372,739 | 12/1994 | Neal et al. . |
| 5,385,643 | 1/1995 | Ampulski . |
| 5,389,204 | 2/1995 | Ampulski . |
| 5,441,204 | 8/1995 | Tappel et al. . |
| 5,503,336 | 4/1996 | Wichmann . |
| 5,505,877 | 4/1996 | Krivohlavek . |
| 5,518,718 | 5/1996 | Ding et al. . |
| 5,525,345 | 6/1996 | Warner et al. . |
| 5,628,463 | 5/1997 | Nakamaura . |

OTHER PUBLICATIONS

*Electrostatic Source Book Catalog*, "Electrostatic Spraying of Liquids", Internet site address http://www.electrostatic-.com/bailey.htm, p. 1, (May 21, 1997).

TOTALSTAT, United Air Specialists, Inc., Electrostaic Fluid Spray Systems, pp. 1–6, May 1997.

EMOLLIENT COMPOSITIONS AND METHODS OF APPLICATION TO A SUBSTRATE BY ELECTROSTATIC SPRAYING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates, in general, to emollient compositions having a specified conductivity and range of viscosity and to methods of applying such emollient compositions to a substrate. The present invention relates, more specifically, to emollient compositions in a liquid form having sufficient conductivity and viscosity to be electrostatically sprayed. Yet more specifically, this invention relates to electrostatic methods of applying conductive emollient compositions, to essentially any substrate, but particularly to the more common forms of paper tissue, e.g. bath or toilet tissue, paper towels, facial tissue and the like. The present invention is especially applicable to large scale commercial, tissue making processes for producing emollient-coated or emollient-carrying tissue.

An "emollient" is defined as an agent that softens and smooths the skin *The American Heritage Dictionary* (1982). Emollients, salves, cleansing agents, and the like have been applied to substrates or carriers, such as tissue paper, for subsequent application to skin to reduce skin irritation and inflamation but also to enhance cleaning. See, e.g. Dake et al. U.S. Pat. No. 4,112,167, the Dake et al. patent being incorporated by reference herein.

Emollients, especially emollients applicable to tissue substrates, generally tend to fall into at least two broad categories, i.e., mineral oil-based emollients and silicone-based emollients. Mineral oil-based emollients usually comprise long chain alcohols. See, e.g., U.S. Pat. Nos. 4,112,167, 4,481,243, and 4,513,051. Silicone-based emollients typically contain polysiloxane of various molecular weights along with other silicone-based compounds. See, e.g. U.S. Pat. Nos. 4,950,545; 5,227,242; 5,246,546; and 5,385,643.

Whether mineral oil-based or silicone-based, such emollients are conventionally applied to tissue paper or other such substrates or carriers by dipping, see e.g., U.S. Pat. No. 3,896,807, air spraying, see, e.g., U.S. Pat. Nos. 5,227,242 and 4,950,545, and printing, see, e.g., U.S. Pat. Nos. 5,389,204; 5,389,643; and 5,525,345. The teachings of the aforementioned patents, as well as the patents mentioned in the previous paragraph are incorporated by reference herein.

Conventional methods used to coat or treat tissue substrates or carriers with emollients, especially paper substrates in a tissue manufacturing processes, have one or more drawbacks. Spraying of emollients onto a substrate or carrier, is accomplished using air pressure to force the composition through an orifice in a sprayer head. This creates a dispersed stream of emollient which is directed toward a substrate surface passing beneath or beside a sprayer head, thereby coating it. Air-driven sprayer heads tend to deliver solutions in the form of unevenly sized droplets, and in an uneven spray pattern. They also tend to require overlapping spray paths or patterns in order to obtain complete substrate coverage. Thus, surfaces coated or treated with emollients delivered by conventional air spray methods tend to be unevenly coated or to be coated excessively in regions of spray overlap. Air-driven sprayers also tend to "overspray" i.e., to miss the substrate. Overspray wastes solution, can cause air pollution, and can present a safety issue to the extent slippery working surfaces are created.

Printing of emollients on substrates, is accomplished by applying an emollient to a heated transfer surface and transferring the emollient to the substrate by placing it in direct contact with the substrate. See, e.g., U.S. Pat. Nos. 5,385,643; 5,389,204 and 5,525,345. Emollients can be applied to absorbent substrates, such as tissue paper, in a very uniform fashion using traditional printing methods. However, printing requires a substantial investment in printing equipment which is generally more costly than spraying equipment. Printing equipment also tends to become clogged as fibers are transferred from tissue paper and thus requires continuous cleaning.

Other methods for applying solutions to substrates, such as tissue paper substrates, have been developed. However, the alternative methods developed so far address some of the problems of the conventional methods discussed above but introduce others. For example, one such alternative application method, disclosed in United States patent U.S. Pat. No. 3,484,275, involves moving an electrostatically charged paper web past a grounded sprayer head. Solution ejected from the sprayer head is attracted to the electrostatically charged paper web substrate and is deposited thereon. The method of the U.S. Pat. No. 3,484,275 patent does not address the uneven droplet size or uniformity of spray problems.

Accordingly, it is an object of the present invention to provide a conductive emollient composition capable of being rapidly and precisely deposited on an substrate, preferably on a tissue or paper substrate, and more preferably on a facial tissue substrate in a commercial tissue making process, using an electrostatic sprayer apparatus.

It is a further object of the present invention to provide a method for rapidly and precisely applying a conductive emollient composition to a moving tissue paper substrate using an electrostatic sprayer apparatus, with minimal overspray and spray overlap, to produce a tissue substrate uniformly coated with emollient.

BRIEF SUMMARY OF THE INVENTION

The present invention encompasses conductive, flowable emollient compositions and methods for applying such compositions to a substrate or carrier such as a moving tissue or paper web. Briefly, in one aspect, an emollient composition of the present invention comprises an admixture of an emollient and a conductivity modifier, wherein the conductivity of the admixture emollient composition is at least about 10,000 picosiemens (a resistivity of $1\times10^{10}$ Ohm-cm). It has been found that particularly preferred emollient compositions in accordance with this invention have a conductivity in the range of 20,000 to 100,000 picosiemens, and most preferably in the range of 40,000 to 80,000 picosiemens.

One skilled in the electrostatic sprayer art will appreciate that a conductive emollient composition of this invention must be flowable, i.e., its viscosity must fall within a range which permits the composition to be electrostatically sprayed from substantially conventional, commercially available, electrostatic sprayer apparatuses. While the upper and lower limits of the viscosity range of a composition of this invention are not especially critical (in part because viscosity sometimes may be modified by heating the composition or adding viscosity modifiers), compositions having a viscosity generally falling in the range of about 1 to 10,000 centipoise, preferably about 1 to about 5,000 centipoise, and most preferably, 1 to about 2,000 centipoise are within the scope of the present invention.

It is to be understood that for purposes of this invention that the terms "emollient" and "emollient composition" are to be very broadly interpreted. U.S. Pat. No. 4,112,167 to Dake et al. includes a lengthy discussion of its meaning of the term "lipophilic cleansing emollient" at column 9, line 67 to column 11 line 9. That discussion, without limitation, is specifically incorporated herein by reference in its entirety.

Generally speaking, emollients, emollient compositions, and conductivity modifiers, contemplated by this invention will be skin compatible or, preferably, generally recognized as safe for short to long term human exposure. It is to be understood that the emollient composition is preferably compatible with topical application to skin. By this it is intended that the emollient composition, when topically applied, will not cause skin irritation or any short or long term adverse skin response. This also means, for example, that it is possible for one or both of the emollient, and conductivity modifier, to be individually incompatible with topical application to skin, and yet the completed emollient composition itself to be skin-compatible and to be safely useable under the circumstances described herein.

Thus, in one aspect the present invention is a method or process of applying a conductive emollient composition to a tissue substrate by means of an electrostatic spray apparatus where the tissue substrate is uncharged or substantially electrically neutral. Generally speaking (and depending in part upon its moisture content), a tissue substrate of this invention will be substantially non-condutive, especially in its final intended usage state. More specifically the present invention is a method of applying a conductive emollient composition to a tissue substrate which comprises the steps of:

(a) providing a flowable emollient composition with a conductivity of at least about 10,000 picosiemens;

(b) providing an electrostatic sprayer apparatus comprising a sprayer nozzle adapted to receive the conductive emollient composition and, when activated, spraying said composition by imparting a first charge thereto, which first charge causes the composition to be repelled from the sprayer nozzle;

(c) providing a substantially electrically neutral tissue substrate;

(d) providing a plate which is electrically neutral or which has a charge opposite that of said first charge, said plate being in a spaced relationship with respect to said sprayer nozzle so that said tissue substrate can be passed therebetween; and (e) passing the tissue substrate between the sprayer nozzle and the plate while activating the electrostatic sprayer assembly to spray the conductive emollient composition toward the plate so that it impinges upon the substrate.

In a preferred practice, the present method comprises the steps of:

(a) providing a flowable emollient composition having a conductivity of at least 10,000 picosiemens;

(b) providing a sprayer apparatus having an inlet means for receiving the emollient composition, the inlet means being fluidically coupled to an outlet means comprising a sprayer head including an electrode means which, when activated, electrostatically repels the emollient composition from the outlet means by imparting a first charge thereto;

(c) providing a substantially electrically neutral tissue substrate;

(d) providing a plate which is electrically neutral or which has a charge opposite that of the first charge and which is separated from said sprayer head and in juxtaposed relation thereto to permit said tissue substrate to be passed between said sprayer head and said plate;

(e) introducing the emollient composition into the inlet means and causing it to flow to the outlet means to contact the electrode means;

(f) activating the electrode means while it is in contact with the emollient composition with the means to apply a charge to the emollient of a first polarity, whereby the emollient composition is electrostatically repelled from the outlet means toward the plate and impinges upon the substrate.

The methods of electrostatic application of emollient compositions of the present invention can be used to apply such emollients to essentially any tissue substrate, absorbent tissue substrates being a particularly preferred class. Exemplary but by no means inclusive absorbent tissue substrates include paper towels, bath or toilet tissue or facial tissue.

BRIEF DESCRIPTION OF THE DRAWINGS

The present invention will now be better understood by reference to the Detailed Description below and the attached Figures in which like numerals are used to refer to like features throughout and wherein.

DETAILED DESCRIPTION OF THE INVENTION

Figure 1:
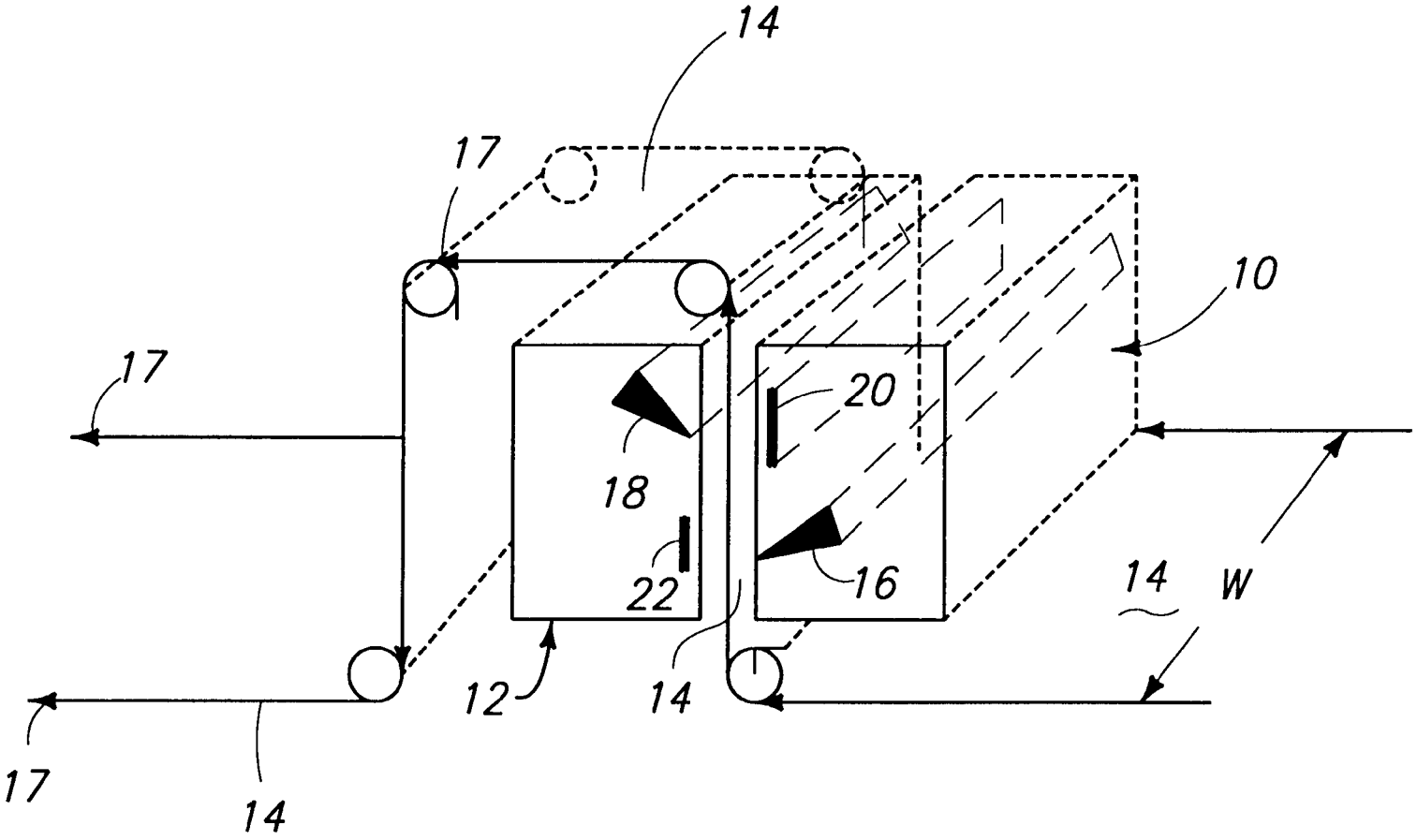
FIG. 1 is a schematic representation of an apparatus with which the present invention can be used showing the path of travel of a tissue sheet or web between two electrostatic sprayer assembles to spray both sides of the web as it passes therebetween.

Electrostatic sprayer systems electrostatically charge a liquid introduced into a sprayer head component of the system which generally includes a charging electrode thereby causing the liquid to become atomized within the sprayer head. The atomized, charged liquid is then ejected from the sprayer head by electrostatic repulsion. The ejected liquid is in the form of very small, relatively uniformly sized, electrostatically charged droplets, which are inherently repelled away from one another and from the similarly charged electrode by the repulsion. Other than any pumping action need to convey the emollient composition to be in contact with the electrode, no mechanical force is required to produce the spray pattern, resulting in the virtual elimination of overspray and misting. The electrostatically sprayed droplets tend to seek out and to adhere to the surface of the substrate being sprayed, producing an extremely uniform and controllable coating. In a practice of this invention, an electrically neutral or oppositely charged plate or "ghost plate", as it is sometimes called, is used to assist in directing electrostatically charged droplets toward a substrate target.

The emollient compositions of the present invention comprise an emollient and a conductivity modifier. The emollient composition will vary depending upon the characteristics of the substrate to which it is applied. Specifically, an emollient is selected which does not deleteriously interact with the substrate, is economical to use, is safe for use in the intended application can be conveniently introduced into and dispensed from the electrostatic sprayer to the substrate, and which is easily released from the substrate to the skin when the substrate is intended for such release. For example, in the case of emollient compositions to be applied to facial tissue, the emollient composition should be releasable from the facial tissue substrate by the simple act of wiping the tissue paper across the skin.

The emollient component of the emollient composition generally can be any emollient suitable for application to human skin as described above, but is preferably either mineral oil-based or a silicone-based. Oil-based emollients generally tend to comprise primarily mineral oil with other additives such as long chain alcohols (e.g., 1-hexadecanol), aloe, and vitamin E. Oil-based emollient formulations are disclosed in U.S. Pat. Nos. 4,112,167, and 4,481,243, and 4,513,051, the disclosures of which are incorporated herein in their entirety by reference hereto. Silicone-based formulations typically comprise polysiloxane of various molecular weights alone or in conjunction with other silicone-based compounds such as tetraoxy silane, dimethyl diethyoxy silance, and ethylene oxide-dimethyl siloxane copolymers. Silicone-based formulations are disclosed in U.S. Pat. Nos. 4,950,545, 5227,242, 5,246,546, and 5,389,204. the teachings of which are incorporated herein by reference in their entirety.

The emollients used in making the emollient compositions of the present invention inherently have a conductivity significantly lower than about 10,000 picosiemens and heretofore were not thought to be suited to application by electrostatic spraying. Illustrative of that fact is the above-noted U.S. Pat. No. 3,484,275 to Lewicki, Jr. Lewicki, Jr. describes a method and apparatus for depositing chemicals in a liquid or semiliquid form by passing an atomized chemical through the field of force created when a distributing or atomizing device requiring mechanical force and an electrode on the opposite side of the moving web form the plates of an electrical capacitor. A spinning disc atomizer is used to create the spray, with no discussion of composition conductivity in the Lewicki, Jr. patent.

The emollient compositions of the present invention comprise an emollient and a conductivity modifier or conductivity enhancer which raises the overall conductivity of the emollient composition to at least 10,000 picosiemens, and more preferably to at least 40,000 picosiemens. Any one of a number of different materials are suitable for use as conductivity modifiers. Suitable conductivity modifiers for use in the present invention include sodium dioctyl sulfosuccinate, DEA Oleth-3 phosphate, and lecithin. Phosphates and succinates are representative families of compounds which constitute preferred conductivity modifiers in accordance with this invention. Generally speaking, the conductivity modifier will comprise from about 0.1% to about 20% by weight (preferably about 0.1 to about 4% by weight) of the conductive emollient composition.

The entire chemical family of quaternary amines are believed to be suitable conductivity modifiers in accordance with this invention. Quaternary amines, unfortunately, while otherwise being compatible with emollients within the contemplation of the present invention, and providing the requisite conductivity to the resulting emollient composition, are known to cause skin irritation. Thus, unless other materials are added to the emollient composition, or the emollient itself, to reduce or eliminate any tendency of quaternary amines to induce skin irritation, quaternary amines do not constitute a favored family of conductivity modifiers in the practice of the present invention.

One of skill in the art will appreciate that some conductivity modifiers are not miscible with every emollient, absent the addition of a compatibilizer to either the conductivity modifier or to the emollient prior to mixing of the two components. For example, when lecithin is used as the conductivity modifier it can be mixed directly with mineral oil to form an oil-based emollient composition of the present invention. Contrastingly, lecithin cannot be mixed directly with silicone emollients, because it is not miscible therewith. However, a sufficient amount of lecithin can be made miscible in a polydimethylsiloxane emollient to raise the conductivity of the emollient to the level required for an emollient composition of the present invention by adding a compatibilizer such as lauryl alcohol. Adding a compatibilizer to polydimethylsiloxane, heating the resulting alcohol/polydimethylsiloxane mixture to cause it to homogenize, and then adding lecithin produces a suitably conductive emollient composition. Typically, long carbon atom chain alcohols (e.g., alcohols having from about 6 to about 20 carbon atoms) are expected to be good compatibilizers for use in making the emollient compositions of the present invention, when compatibilizers are necessary to ensure the miscibility of a conductivity modifier in an emollient.

Emollient compositions of the present invention, in addition to being conductive as described herein must be flowable or to have a viscosity which is suitable for the compositions to be useable in conventional electrostatic spray apparatuses. For example the TOTALSTAT electrostatic spray system discussed in greater detail below is described to be workable using fluids having a viscosity of from 1 to 2,000 centipoise. Emollient compositions having greater viscosities, i.e., viscosities as high as 1 to about 10,000 centipoise may be used especially, for example, if it is possible to heat the liquids shortly before application or to take other steps (e.g., adding a viscosity modifier or diluent) which permits the composition to become sufficiently flowable so as to be charged and to pass through the electrostatic sprayer apparatus as is described above.

The method of application aspect of this invention is to apply emollient compositions to at least one surface of any one of a number of different substrates designed to come into contact with human skin, including: articles of clothing such as gloves; cellulosic, cotton, or synthetic wiping cloths; and tissue paper substrates, such as paper towels, toilet paper, and facial tissue. Generally speaking, substrates to which the present invention is particularly applicable will be non-conductive and absorbent. While absorbent substrates are a particularly preferred class of substrates, the present invention should not be thereby limited. In a further preferred practice, a conductive emollient composition of the present invention is applied to a both surfaces of a substrate substantially concurrently.

The present methods are more preferably used to coat at least one surface of a tissue paper substrate with an electrostatically sprayable emollient composition, most preferably to coat at least one surface of a tissue web in a commercial paper making process which ultimately becomes facial tissue. One of skill in the art will appreciate that the particular emollient composition applied to an absorbent substrate using the electrostatic spray method of the present invention will depend upon the type of material to which it is applied. The conductive emollient composition may be chosen to be capable of being adsorbed, absorbed or impregnated into the substrate, depending upon the intended use of the emollient-carrying substrate and whether the emollient must be carried or retained by the substrate or whether the substrate is intended to deliver the emollient. For example, the surface of gloves which come into contact with human skin are preferably impregnated with a formulation of emollient composition which is released on exposure to moisture in the form of sweat released while in use. Facial tissue, on the other hand, is preferably coated with a formulation of emollient composition which is released from the facial tissue substrate as it is wiped against the skin, in the normal course of use. One of ordinary skill in the art would be able to select a formulation for an emollient suitable for application to any one of a number of different absorbent substrates. However, the emollient composition and methods of the present invention are discussed below in terms of their application to a tissue web, particularly a non-conductive, absorbent tissue web.

FIGS. 1–4 illustrate one electrostatic spray apparatus that could be used in the practice of the method of this invention. One skilled in the art will appreciate that the present inventive method and composition(s) may be used with essentially any commercially available electrostatic sprayer apparatus and that the claims should not be limited to the electrostatic sprayer structure shown.

Referring to FIG. 1, there is shown, schematically, two opposing sprayer assemblies 10, 12 which are arranged and adapted to deposit electrostatically, a composition of the present invention on opposing surfaces of a tissue moving substantially vertically upward. As is shown, tissue web 14 has a width W and is traveling in the direction of arrow 17 and is supported by a web or wire (not shown) which passes between sprayer assemblies 10,12. This arrangement has been found to be particularly advantageous in that electrical arcing between sprayer assemblies is minimized. On skilled in the electrostatic sprayer art will appreciate that many sprayer assembly configurations may be used with the present invention, the primary design consideration being that electrical arcing must not occur.

Sprayer assemblies 10 and 12 each comprise an electrostatic sprayer head 16, 18 and a neutral or charged plate (sometimes referred to as a "ghost plate") 20,22. Sprayer heads 16,18 are shown in phantom to be substantially the same width W as web 14 and are angled to spray slightly downward. Sprayer heads 16,18 also may spray substantially horizontally or upwardly. It is to be noted that sprayer assembles 10 and 12 each have plates 20,22 associated therewith but that each sprayer head cooperates with a charged plate in the other assembly. As is more completely described below, sprayer head 18 imparts a first charge to a conductive liquid flowing therethrough and is repelled therefrom in the form of a spray and is electrostatically drawn toward oppositely charged plate 20. Before reaching plate 20 the electrostaticallly-generated spray impinges upon and is collected by web 14. Similarly, sprayer head 16 cooperates with plate 22 to electrostatically spray conductive emollient on the opposite surface of web 14. In this manner, both sides of web 14 are electrostatically sprayed, rapidly and uniformly in a substantially concurrent steps.

Figure 2:
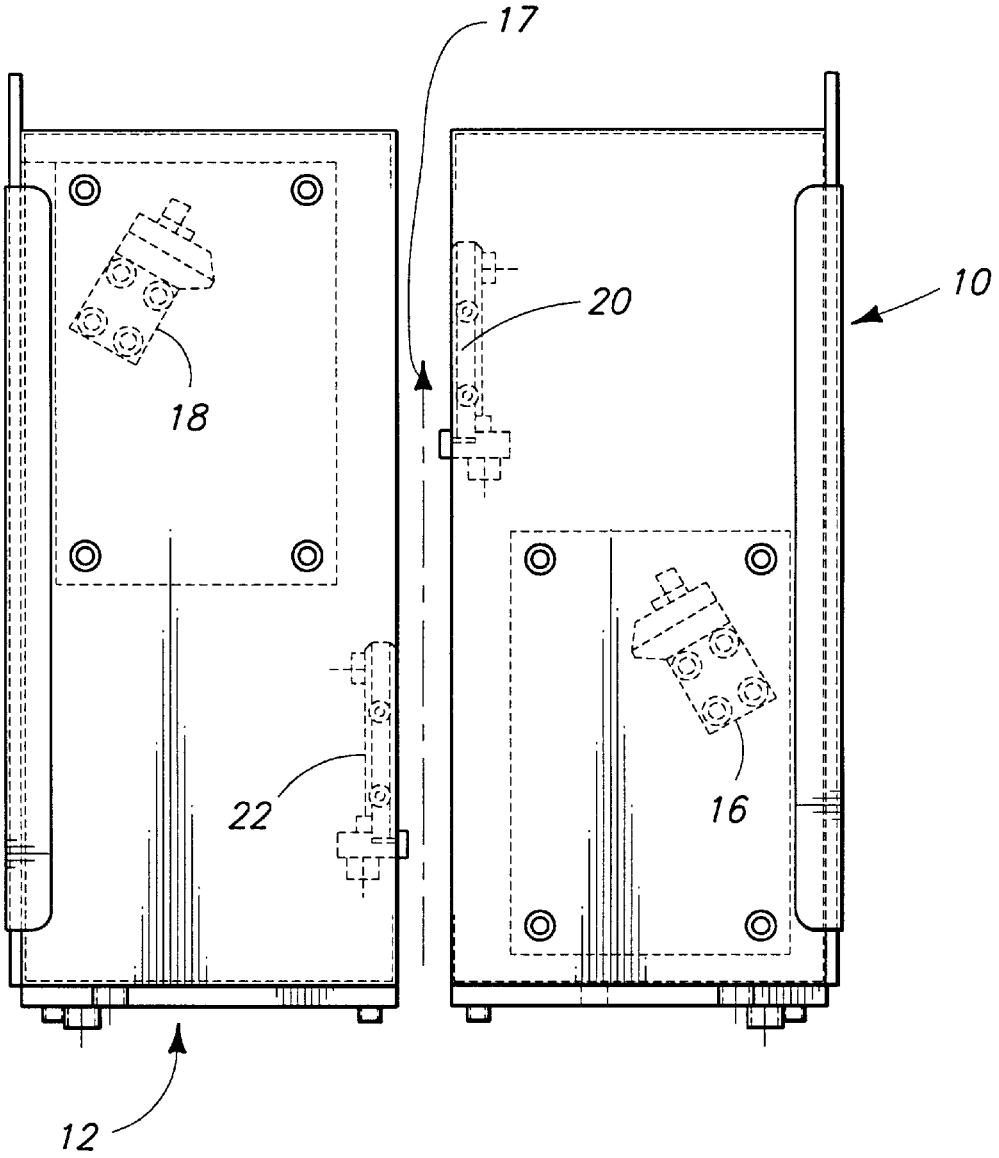
FIG. 2 is a detailed end sectional view of opposing sprayer assemblies schematically shown in FIG. 1.

FIG. 2 is a detailed, end view of the schematic sprayer assemblies shown in FIG. 1. The detailed path of web 14 has been omitted from FIG. 2 for illustrative purposes. Also, as is more clearly shown in FIG. 3, the conductive emollient feeder mechanism has been deleted.

Figure 3:
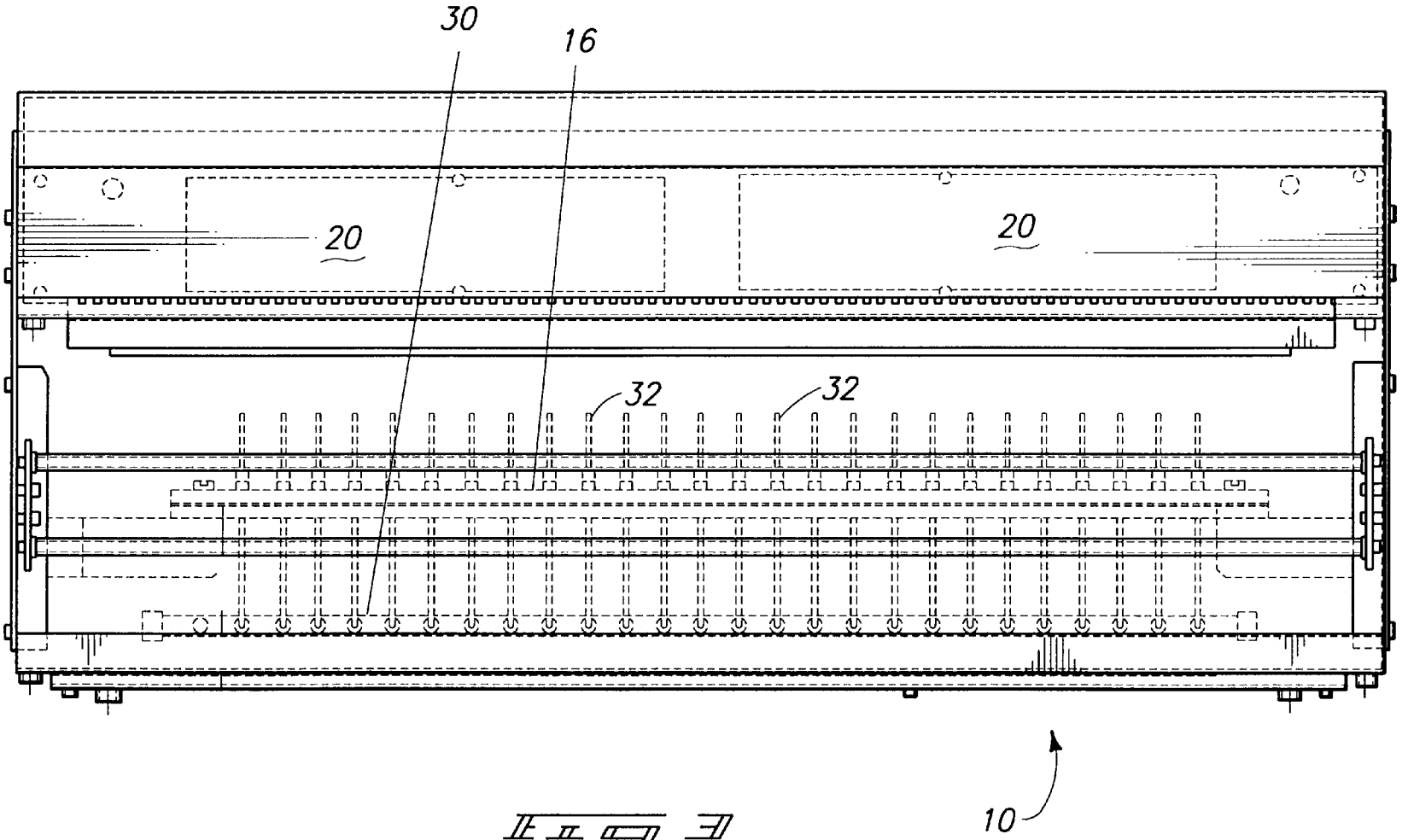
FIG. 3 is a front perspective view of a sprayer assembly such as that shown in FIG. 4.

FIG. 3 shows a front view of sprayer assembly 10 shown schematically in FIG. 1 and end on in FIG. 2. In addition to the structures shown in FIGS. 1 and 2, conductive emollient feeder mechanism including a header 30, multiple hook-shaped feeder pipes 32 fluidically connected to header 30 and to nozzle assembly 16 provide a composition of this invention to the sprayer assembly 10. Sprayer assembly 12 would appear substantially the same as assembly 10 with the sprayer heads and conductive plates vertically reversed.

Figure 4:
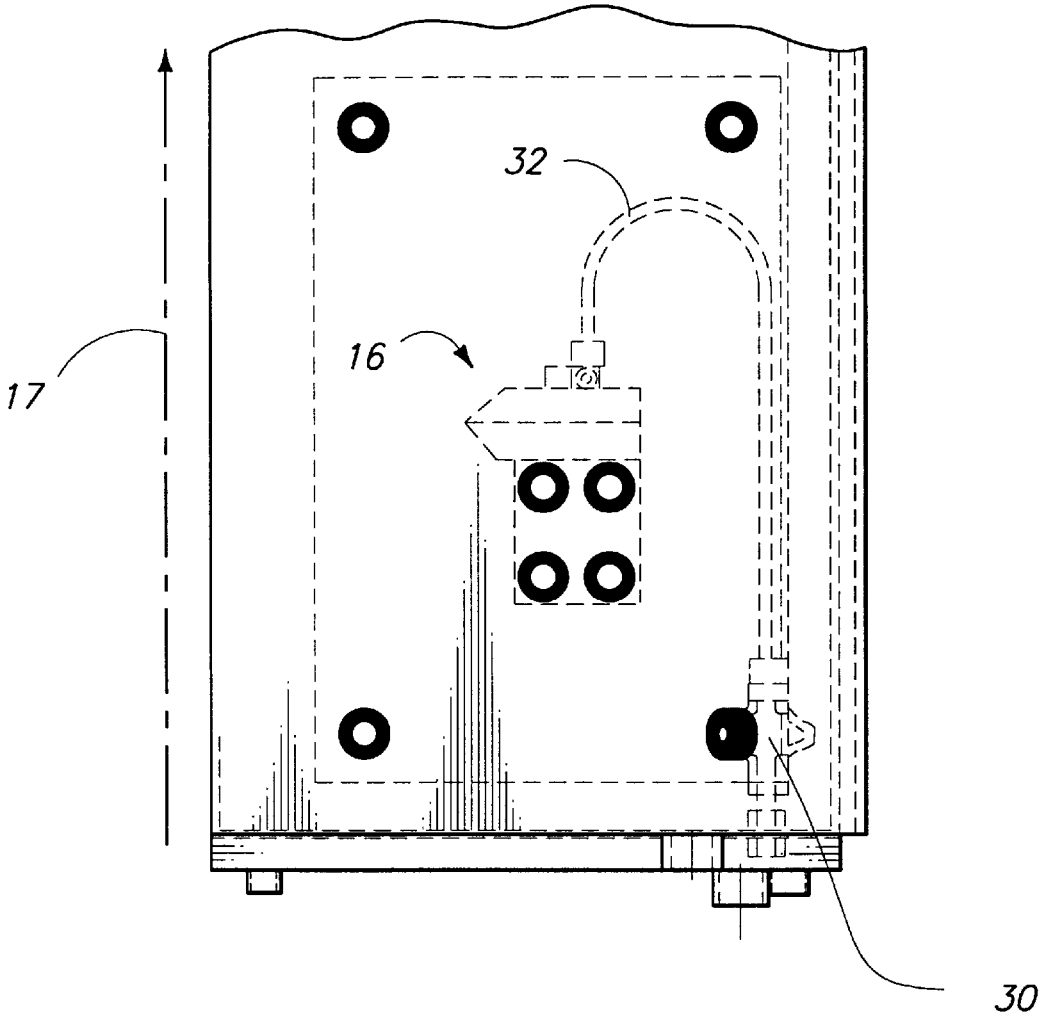
FIG. 4 is an end view of a single sprayer head-feeder pipe assembly.

FIG. 4 shows a side view of a single feeder pipe 32 connected to nozzle assembly 16 and to fluid header 30 as they would likely be arranged in a large scale paper making process.

Figure 5:
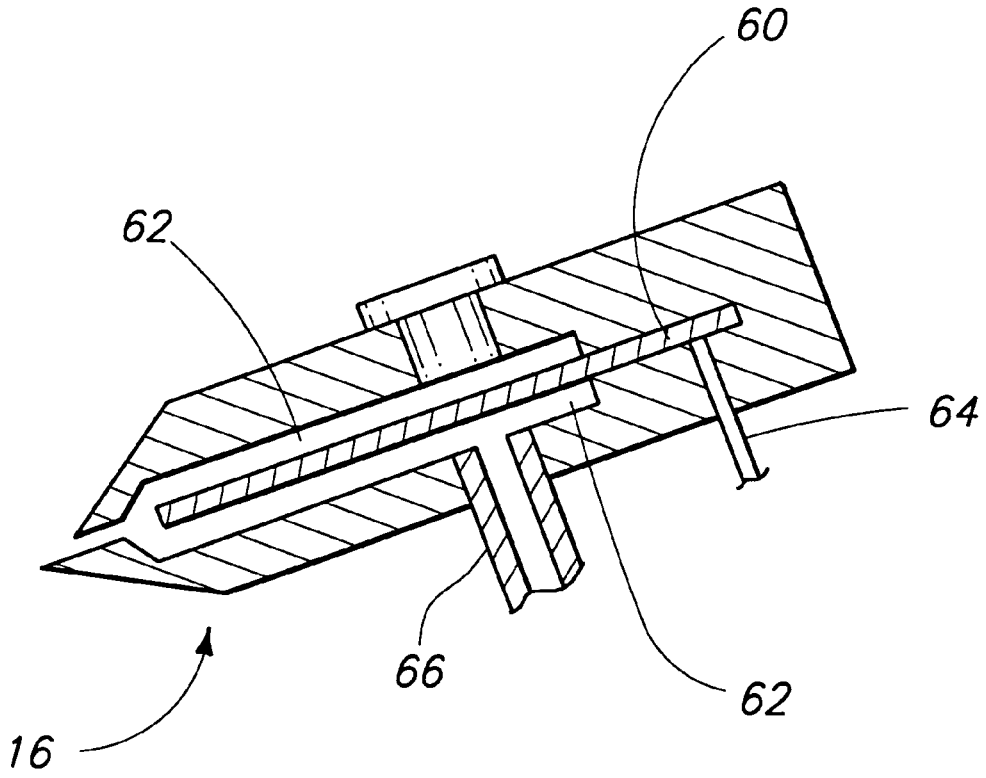
FIG. 5 is an side, sectional view of an electrostatic sprayer head useable in a practice of this invention.

FIG. 5 shows the internal details of one embodiment of an electrostatic sprayer nozzle assembly 16. FIG. 5 generally illustrates an electrically conductive electrode or metallic shim 60 encapsulated within and supported by a non-conductive material such as an acetal. The non-conductive material defines an internal cavity 62 into which electrode 60 projects. Electrode 60 is electrically coupled via lead 64 to a high voltage DC source (not shown). Electrode 60 is also coupled, fluidically via input pipe or feeder pipe 66, to a source of conductive emollient in accordance with this invention. (Although input pipe 66 is shown to deliver conductive emollient from the below, it is to be understood that delivery of conductive emollient from either above or below nozzle assembly 16 is within the contemplation of the present invention.) Uniform and precisely sized droplets are created by introducing a high voltage DC charge to the fluid as it enters cavity 62 and passes over electrode 64. The conductive emollient passing from input pipe 66 into cavity 62 is rapidly charged by electrode 64 and since the charge of electrode 64 is the same as that of the droplets, the droplets are electrostatically expelled from the nozzle 16. The details of the electrostatic sprayer assemblies, are well known to one skilled in the electrostatic sprayer art. U.S. Pat. No. 5,503,336 to Wichmann "High volume-Low Volume Electrostatic Dispensing Nozzle Assembly", U.S. Pat. No. 5,209,410 to Wichmann et al. "Electrostatic Dispensing Nozzle Assembly", U.S. Pat. No. 4,749,125 to Escallon et al. "Nozzle Method and Apparatus", and U.S. Pat. No. 5,441,204 to Tapel et al. "Electrostatic Fluid Distribution Nozzle", all of which are incorporated herein by reference, depict electrostatic spray assemblies, especially including electrostatic sprayer nozzles, which could be used in the practice of the present invention.

As is discussed extensively above, the present composition and method involve the utilization of an electrostatic sprayer apparatus or assembly. While many electrostatic spray systems known to the art are likely to be useable with the present invention, the TOTALSTAT electrostatic spray system from United Air Specialists, Inc. (Cincinnati, Ohio, USA) described in a document downloaded from the Internet site address http://www.uasinc.com/total.html on May 16, 1997 constitutes a preferred assembly. The above disclosure of an electrostatic spray system is incorporated by reference herein in their entirety.

One skilled in this art will appreciate that the primary application of the present invention is the electrostatic spraying of a conductive emollient composition in accordance herewith upon a tissue web, especially a moving tissue web, as in the commercial production of tissue paper. U.S. Pat. No. 4,112,167 to Dake, especially at column 10, line 55 and continuing to column 11, line 9, which disclosure is specifically incorporated by reference herein discloses the general ranges for the quantity of conductive emollient to be applied to the paper web. Generally speaking, application of conductive emollient in accordance with this invention may be lower than that disclosed by Dake, falling in the range of 3% to 5% of the composition of the web, by weight. Broadly speaking, an emollient composition of this invention may comprise 2% to about 25% by weight of the tissue web.

As noted above, the present invention is intended for use in the continuous production of a paper web as in a paper making process. Where the present invention will be utilized in a given paper making process will, of course, be determined by the user. Never-the-less, generally speaking, the present invention will probably be applied in a tissue making process after removal of a substantially dried tissue web from the Yankee dryer and before the parent roll. U.S. Pat. No. 5,385,643 to Ampulski, especially at column 16, lines 10–52, which disclosure is specifically incorporated by reference herein in its description of FIG. 1 thereof, is especially instructive.

The following examples are presented to illustrate some of the aspects of the present invention. These examples should not be construed so as to limit the scope of the present invention.

EXAMPLE 1

An oil based emollient composition was produced as follows. DEA oleth-3 phosphate conductivity modifier was added to and mixed with mineral oil emollient. The conductivity of the resulting composition was measured using a conductivity measuring apparatus commercially available from Emcee, Inc of Venice, Fla., U.S.A. and found to be 60,000 picosiemens. DEA oleth-3 phosphate comprised about 2% by weight of the resulting conductive emollient composition.

EXAMPLE 2

A silicone based emollient composition was produced as follows. Lauryl alcohol was added to and mixed with a polydimethylsiloxane emollient at 25% by weight. The resulting alcohol/silicone mixture was then heated to a temperature of at least 120° F. and no higher than 130° F. to solubilize the lauryl alcohol in the polydimethylsiloxane. Lecithin was then added to the heated alcohol/silicone mixture for a final concentration of lecithin of about 15% by weight in the mixture. Under these conditions, the lecithin was fully dispersed in the silicone emollient, and the resulting emollient composition was found to have a conductivity of about 40,000 picosiemens.

EXAMPLE 3

The oil based emollient compositions prepared as described in Example 1 above, was electrostatically sprayed onto a moving tissue web using a TOTALSTAT brand electrostatic sprayer from the UAS corporation in Cincinnati, Ohio. FIGS. 1–5 depict the apparatus as it was arranged relative to the web. Conductive emollient was applied to a tissue web moving at a speed of about 1,000 feet/minute at a rate of 12.5 lbs./minute. The web, which is generally 100 inches wide, had a basis weight of 20 lbs. per 3,000 square feet of web producing a rate of emollient application of approximately 22% by weight.

EXAMPLE 4

A representative number of tissue samples were collected which had been electrostatically sprayed with a composition according to Example 1 in a commercial tissue-making process. Those samples were measured for emollient content uniformity. Comparative tissue samples also were taken from the same commercial tissue making process prior to the point where the tissue web was sprayed with the condutive emollient. The uniformity of weight of the sprayed samples was compared with that unsprayed samples and it was concluded that any uniformity of tissue weight introduced by the spraying process was statistically less than the weight non-uniformity of the tissue samples themselves. Put otherwise, the electrostatic spray application of conductive emollient introduced no additional weight deviation in the tissue web than was already present in the web itself simply due to the precision of the tissue web-making process itself.

We claim:

1. A conductive, flowable emollient composition for electrostatic spraying comprising:

an emollient selected from the group consisting of mineral oil and silicon;

0.1–20% by weight of a conductivity modifier, the conductivity modifier being compatible with the emollient and present in sufficient quantity so the resulting emollient composition has a conductivity of at least 10,000 picosiemens and a viscosity of less than about 10,000 centipoise, and wherein the conductivity modifier is selected from the group consisting of lecithin, sodium dioctylsulfosuccinate, and DEA oleth-3 phosphate; and a compatibilizer selected to enhance the miscibility of the conductivity modifier in the emollient, and wherein the compatibilizer comprises a long chain alcohol having 6–20 carbon atoms.

2. The emollient composition of claim 1, wherein the silicone emollient comprises at least one polysiloxane species and at least one other silicone-based compound selected from the group consisting of tetraoxysilane, dimethyl diethyoxy silane, and ethylene oxidedimethyl siloxane copolymer.

3. The emollient composition of claim 1, wherein the conductivity modifier is present in sufficient quantity to make the conductivity of the composition fall in the range of about 20,000 picosiemens to about 100,000 picosiemens.

4. An emollient composition according to claim 1, wherein the conductivity modifier is present in sufficient quantity to make the conductivity of the composition fall in the range of about 40,000 to about 80,000 picosiemens.

5. The emollient composition according to claim 1, wherein the composition has a viscosity falling in the range of about 1 to about 5,000 centipoise.

6. The emollient composition according to claim 1, wherein the composition has a viscosity falling in the range of about 1 to about 2,000.

* * * * *